United States Patent [19]

Cochrane

[11] 4,025,217

[45] May 24, 1977

[54] TUG UNIT FOR RAIL-MOUNTED SLIP-FORM PAVER

[75] Inventor: Kenneth Alfred Cochrane, Matlock, England

[73] Assignee: Robert McGregor & Sons Limited, Manchester, England

[22] Filed: Jan. 8, 1976

[21] Appl. No.: 647,436

[30] Foreign Application Priority Data

Jan. 8, 1975 United Kingdom ..... 772/75

[52] U.S. Cl. ..... 404/100; 404/106

[51] Int. Cl.[2] ..... E01C 11/16

[58] Field of Search ..... 404/106, 100, 105, 101, 404/98, 108, 83

[56] References Cited

UNITED STATES PATENTS

| | | | |
|---|---|---|---|
| 1,909,458 | 5/1933 | Dieckmann | 404/106 X |
| 2,591,502 | 4/1952 | Bohannan | 404/106 |
| 3,107,592 | 10/1963 | Mengel | 404/106 |
| 3,177,784 | 4/1965 | Retzlaff | 404/108 |
| 3,225,668 | 12/1965 | Maginniss | 404/101 X |
| 3,228,311 | 1/1966 | Mengel | 404/101 |
| 3,280,711 | 10/1966 | Jennings | 404/98 |
| 3,477,354 | 11/1969 | Rink | 404/105 X |
| 3,606,827 | 9/1971 | Miller | 404/98 |
| 3,657,977 | 4/1972 | Hudis | 404/108 |

*Primary Examiner*—Nile C. Byers

[57] ABSTRACT

A means for towing and feeding a rail-mounted slip form paver has a self-propelled tug unit, a draw bar structure adapted to connect the unit and the paver in spaced relation, a hopper on the tug for receiving fluid concrete and including archimedes screws for delivering the fluid concrete to one end of a conveyor carried by the draw bar structure, a discharge chute at the other end of the conveyor for delivering fluid concrete in advance of the paver and a separating member between the paver and the tug unit operable to split and space continuous bundled steel rod reinforcement for incorporation in the concrete base laid by the paver.

7 Claims, 5 Drawing Figures

TUG UNIT FOR RAIL-MOUNTED SLIP-FORM PAVER

FIELD OF THE INVENTION

This invention relates to a means for towing and feeding a rail-mounted slip form paver and also to a method of slip form paving.

SUMMARY OF THE INVENTION

According to the present invention a means for towing and feeding a rail-mounted slip form paver comprises a self-propelled tug unit, a draw bar unit structure adapted to connect said unit and the paver in spaced relation, a conveyor carried by the draw bar structure and means on the tug unit for supplying fluid concrete to the conveyor for delivery in advance of the paver.

Preferably there is also provided, between the tug unit and the paver, a rail-mounted separator which is movable with the tug unit and operable to split and space continuous bundled steel rod reinforcement for incorporation into the concrete base laid by the paver.

The invention also includes a method of slip form paving comprising the steps of:

accurately setting rail members for line and level in a location where it is desired to slip form pave, locating a paver, mounted on wheels, on the rail members, and drawing the paver along the rails at a desired speed of advance by a draw bar structure interconnecting the paver with a spaced self-propelled tug unit whilst simultaneously supplying fluid concrete in advance of the paver from a conveyor carried by the draw bar structure.

Preferably the method includes the additional step of forming holes in the paved concrete for the permanent fixture of rail members.

The apparatus of the present invention is particularly applicable to the paving of a base for railway track for which comparatively narrow slabs are required with a high degree of surface accuracy.

BRIEF DESCRIPTION OF THE DRAWINGS

The invention will now be described by way of example with reference to the accompanying drawings which illustrate a preferred embodiment of the invention and in which.

DESCRIPTION OF THE PREFERRED EMBODIMENT

Figure 1:
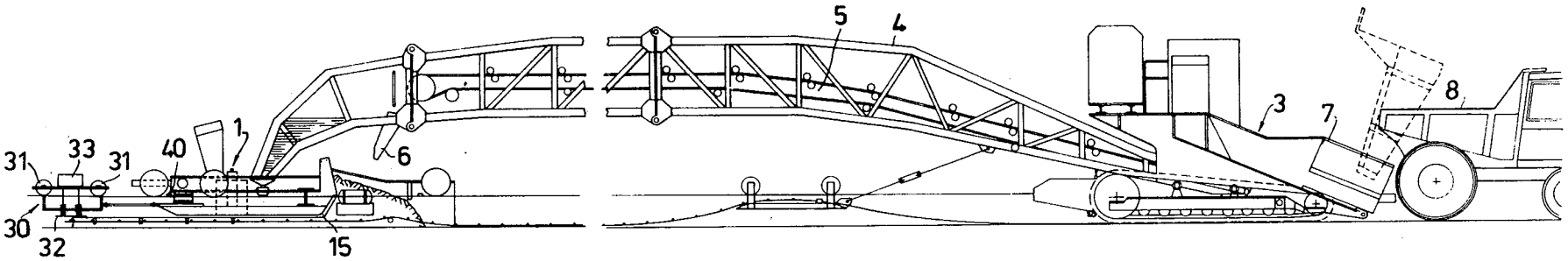
FIG. 1 is a side elevation of a slip form paver and tug unit centrally broken away.

In the drawings a slip form paver 1 is mounted on wheels 2 so that it may be drawn along rails (indicated by broken lines in FIG. 2) which have been set accurately for line and level in a desired location. The paver 1 is not self-propelled but is drawn by a tug unit 3 spaced from the paver but interconnected by a draw bar structure 4.

The draw bar structure 4 carries a conveyor 5 which delivers fluid concrete from the tug unit 3 in advance of the paver 1 through an adjustable discharge chute 6. Fluid concrete is supplied to a hopper 7 on the tug unit 3 by a concrete dumper 8 and is delivered to the conveyor 5 by archimedes screws 9. The tug unit 3 is mounted on tracks 10 of a height sufficient to allow the passage of a bundle of continuous steel welded reinforcement rods 12 beneath the chassis of the unit 3. The tracks 10 of the tug unit 3 are each individually controllable and are driven by separate variable speed motors (not shown).

The space between the paver 1 and tug unit 3 forms a convenient working area for preparing and placing the reinforcement rods 12 in their preferred positions. This is done by a separator member or "comb" 13 (see FIG. 4) which has wheels 14 and is drawn along the same rails as the paver 1 by the tug unit 3. Suitably the separator member 13 is attached to the tug unit 3 by connectors 14—see FIG. 1.

The paver 1 itself is of conventional form including a conforming plate 15, vibrators 16, a reinforcement guide 17 to raise the separated reinforcement rods 12 to their preferred level and devices 18 for forming holes in the concrete paved carriageway which form mounting fixtures e.g. for a railway track. For a more complete description of the devices included on the paver reference should be made to our prior British Pat. Nos. 1,166,654, 1,275,980 and 1,315,161 and to our co-pending Application No. 1,405,178.

Figure 2:
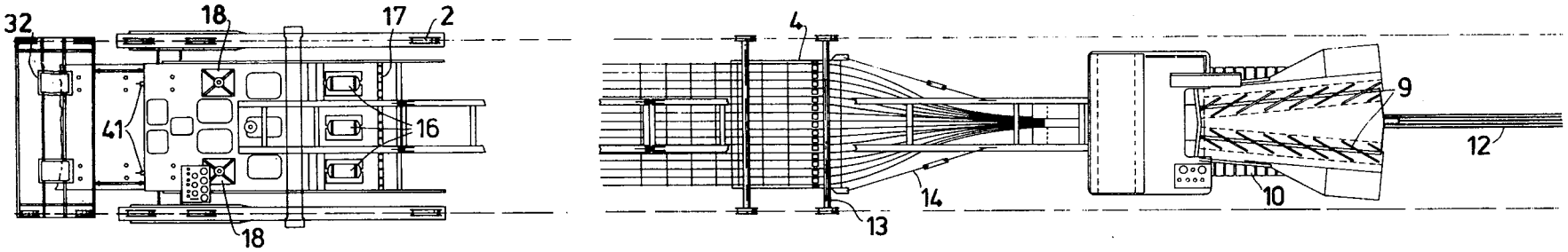
FIG. 2 is a plan view of FIG. 1.

FIGS. 1 and 2 show towed behind the paver 1 a movable carriage 30 supported on wheels 31 which run along the same guide rails as the paver 1. The carriage 30 supports spaced rail seat floats 32 which smooth the concrete in the areas on which rails are to be laid and also in the adjacent areas as a final correction. The carriage 30 also supports electronic equipment in the form of a concrete profile monitor 33 which is used to monitor the level of the finished concrete relative to the guide rails by registering the movement of the rail seat floats on a roll graph. A reading is taken by the concrete profile monitor 33 for each rail seat and the data collected onto a dual roll scale. If the levels are in error by more than a pre-determined amount in the order of 5mm an alarm warning is actuated: the collection of the level data also provides a permanent record to assist with subsequent surveying and remedial work.

Figure 3:
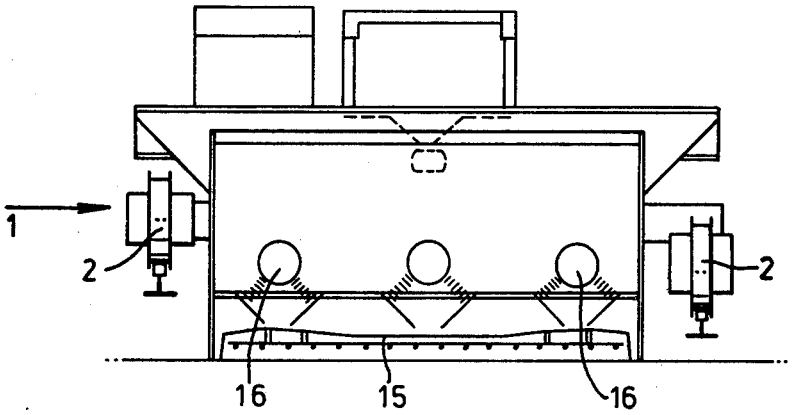
FIG. 3 is a sectional view on 3—3 of FIG. 2.
Figure 4:
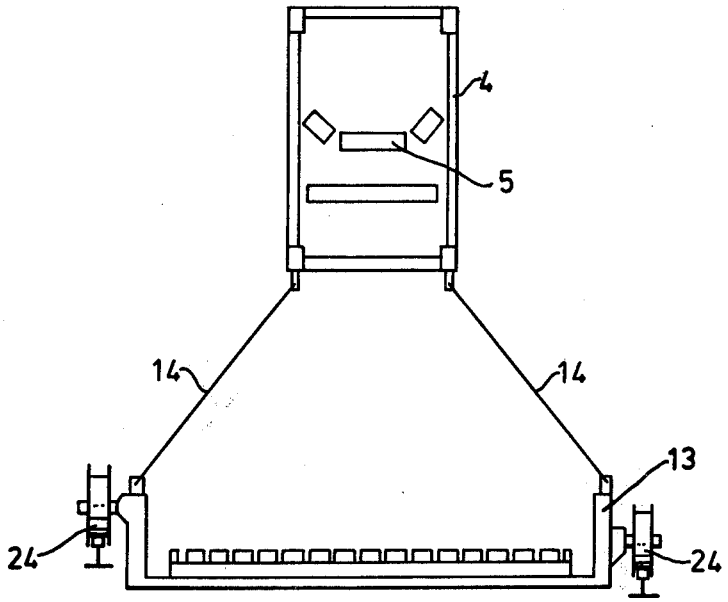
FIG. 4 is a sectional view on 4—4 of FIG. 2.
Figure 5:
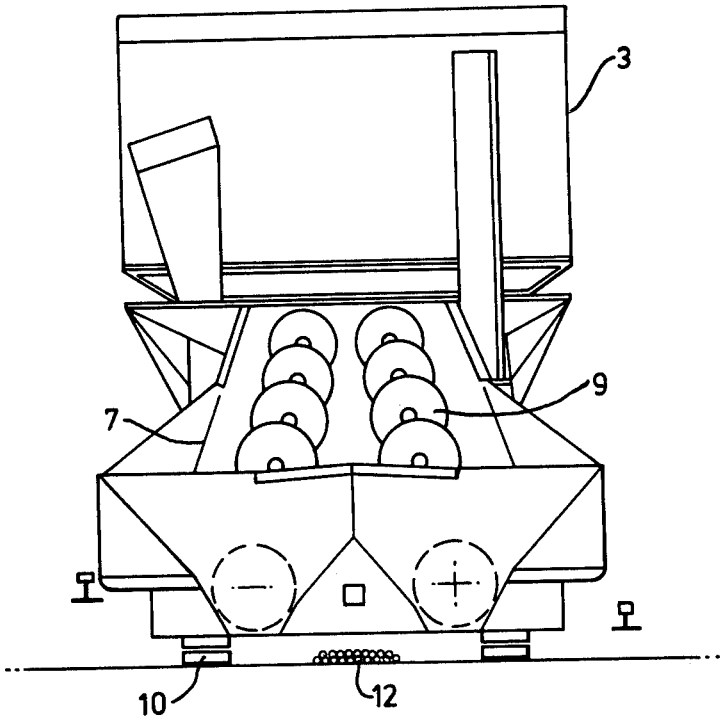
FIG. 5 is an end view of the tug unit shown in FIG. 2.

In order to accomodate the height at which the temporary rail track is laid and yet lay a concrete carriageway of a desired thickness the wheels 2 of the paver 1 and wheels 14 of the separator member 13 are adjustable so that their height may be varied accordingly see particularly FIGS. 3 and 4. In operation it is possible for the hydraulic pressure produced by an excess quantity of concrete to lift the paver 1 from the guide rails. The paver 1 therefore is provided with sensors 40 which monitor the contact of wheels 2 with the guide rails and give an alarm warning if the paver 1 leaves the guide rails.

As an additional adjustment in laying concrete of a desired thickness the conforming plate 15 is preferably provided with alternative side fixings (not shown) on the side members of the paver 1 so that the height of the plate 15 relative to the paver 1 may also be adjusted as desired. It is also understood that conforming plates are manufactured in various widths and configurations to accomodate the requirements of different slabs for a particular application and therefore a suitable conforming plate will be fitted to the paver 1 accordng to the configuration of carriageway it is to provide.

The hydraulic pressure referred to above can also induce "pumping"—a state where fluid concrete immediately to the rear of the paver conforming plate 15 if forced to a higher level than the conforming plate causing "waving" of the concrete surface. The paver 1 therefore also includes concrete pumping sensors 41 which detect when such "pumping" is occuring and gives an appropriate alarm warning so that the situation can be rectified.

In addition to the above features the apparatus of the present invention preferably also includes:

i. a generator mounted on the tug unit for providing electrical power to the paver, ii. a sensor unit for steering the tug unit by sensing one of the rails, iii. means for individually controlling the archimedes screws so that one or both screws can be used depending upon the required rate of fluid concrete, iv. a control device effecting rotation of the or each archimedes screw only when the conveyor is operative, and v. an emergency stop switch provided on both the paver and the tug unit so that the generator may be disconnected by either a person controlling the paver or the tug unit driver; if the emergency stop switch is operated then the generator has to be manually reconnected before paving can be resumed.

In operation fluid concrete is brought to the tug unit 3 by a concrete dumper 8 and emptied into the hopper 7. The archimedes screws 9 and conveyor 5 are then actuated so that the fluid concrete is conveyed over the draw bar structure 4 and discharge chute 6. Simultaneously movement of the tug unit 3 is started and the unit passes over the bundle of reinforcing rods 12 drawing the separator member 13 behind so as to separate the rods into a spaced relationship as shown in FIG. 2. Once separated the rods 12 are raised to their required height and fed into the fluid concrete by the reinforcement rod guide 17 as the paver 1 is drawn forward by the tug unit 3.

The concrete deposited before the paver 1 is conformed in the conventional manner and as explained above various operations the subject of our prior patents and co-pending application may be effected: the monitor 33 and sensors 40 and 41 ensuring that paving is effected as desired.

As an alternative to having fluid concrete supplied to the tug unit by a concrete dumper the tug unit may be include a concrete mixer so that fluid concrete is prepared on the tug unit. In this case raw aggregates would be supplied to the tug unit 3 either by a dumper similar to that shown in the drawing or by a conveyor or the aggregates may be supplied ahead of the unit to be subsequently scooped up onto the unit by suitable means as the unit moves forward.

What I claim is:

1. Apparatus for paving railway track comprising a self-propelled tug unit, a slip form paver adapted to be mounted on prelocated paving rails accurately set for line and level, a draw bar unit structure connecting the tug unit and the paver in spaced relation, a conveyor carrier by the draw bar structure for supplying fluid concrete in advance of the paver, a conforming plate on the paver for moulding the fluid concrete to a desired surface configuration, a movable rod separator disposed intermediate the spaced tug unit and paver for splitting continuous bundled steel rod reinforcement and spacing the rods across the width of the track for incorporation into the body of the concrete from the front, means on the paver for picking up the separated rod reinforcement and introducing the reinforcement into the concrete, and means on the paver for forming holes in the paved concrete for the permanent fixture of rail means.

2. Apparatus according to claim 1 wherein the separator is rail-mounted and is movable with the tug unit.

3. Apparatus according to claim 1 wherein fluid concrete is supplied to the conveyor by archimedes screws on the tug unit and is delivered in advance of the paver by an adjustable discharge chute.

4. Apparatus according to claim 1 further including monitoring means supported on a rail-mounted carriage movable with, but behind, the paver for monitoring level of the conformed concrete and comprising spaced rail seat floats which smooth the concrete in the areas in which rail members are to be laid and the movements of which are recorded and compared with the prelocated paving rails to ensure an accurate surface finish.

5. Apparatus according to claim 1 wherein disposed behind the conforming plate of the paver is a sensor for detecting an excess build-up of liquified concrete resulting from an increase in hydraulic pressure due to the supply of an excess quantity of concrete in advance of the paver.

6. Apparatus according to claim 1 including a sensor for monitoring the contact of wheels of the paver with the prelocated rails on which the paver is mounted.

7. A method of slip-form paving a railway track comprising the steps of:

accurately setting paving rail members for line and level in a location where it is desired to slip form pave, locating a paver, mounted on wheels, on the rail members, drawing the paver along the rails at a desired speed of advance by a draw bar structure interconnecting the paver with a space self-propelled tug unit, supplying fluid concrete to a conveyor carried by the draw bar structure to be deposited in advance of the paver, locating a movable separator, mounted on wheels, on the rail members intermediate the paver and the tug unit, laying a bundle of continuous rod reinforcement between the paving rail members, drawing the separator along the rail by means of the tug unit to split and separate the bundled rods into spaced disposition, introducing the spaced reinforcement rods into the concrete being paved at a height determined by a rod guide means on the paver, conforming the concrete surface configuration by a conforming plate on the paver, and forming holes in the paved concrete for the permanent fixture of rail members.

* * * * *

UNITED STATES PATENT OFFICE

CERTIFICATE OF CORRECTION

Patent No. 4,025,217 Dated May 24, 1977

Inventor(s) Kenneth Alfred Cochrane

It is certified that error appears in the above-identified patent and that said Letters Patent are hereby corrected as shown below:

Col. 2, line 43, "accomodate" should read -- accommodate --

Col. 2, line 62, "accomodate" should read -- accommodate --

Col. 4, line 33, after prelocated add -- paving --

Col. 4, line 52, after rail add -- member --

Col. 4, line 58, after concrete add -- to a desired --

Signed and Sealed this

*sixteenth* Day of *August 1977*

[SEAL]

*Attest:*

RUTH C. MASON
*Attesting Officer*

C. MARSHALL DANN
*Commissioner of Patents and Trademarks*